United States Patent [19]

Uebersax

[11] Patent Number: 4,745,785

[45] Date of Patent: May 24, 1988

[54] MANUALLY OR ELECTRICALLY DRIVEN LOCK

[75] Inventor: Othmar Uebersax, Wetzikon, Switzerland

[73] Assignee: Bauer Kaba AG, Wetzikon, Switzerland

[21] Appl. No.: 872,004

[22] Filed: Jun. 9, 1986

[30] Foreign Application Priority Data

Jun. 12, 1985 [CH] Switzerland ..... 2477/85

[51] Int. Cl.[4] ..... E05B 17/04; E05B 47/00

[52] U.S. Cl. ..... 70/279; 70/380

[58] Field of Search ..... 70/279, 379 R, 379 A, 70/380, DIG. 60, 277, 280, 275

[56] References Cited

U.S. PATENT DOCUMENTS

| | | | |
|---|---|---|---|
| 3,854,310 | 12/1974 | Paull et al. | 70/279 X |
| 3,894,417 | 7/1975 | Taniyama | 70/277 X |
| 4,031,729 | 6/1977 | Gretler | 70/380 |
| 4,593,546 | 6/1986 | Allen | 70/380 |

FOREIGN PATENT DOCUMENTS

| | | | |
|---|---|---|---|
| 1205863 | 11/1965 | Fed. Rep. of Germany | 70/380 |
| 2135927 | 3/1973 | Fed. Rep. of Germany | 70/380 |
| 2280773 | 2/1976 | France | 70/277 |
| 2024922 | 1/1980 | United Kingdom | 70/277 |
| 2071197 | 9/1981 | United Kingdom | 70/277 |
| 224333 | 4/1969 | U.S.S.R. | 70/380 |

*Primary Examiner*—Lloyd A. Gall

*Attorney, Agent, or Firm*—Walter C. Farley

[57] ABSTRACT

A safety lock cylinder is constructed so that a door can be opened or closed manually from one side, preferably the outside by inserting a key in a key guide and from the other side with a motor. The remote control of the lock can be prevented, if desired. By manually closing the door with the key in the key guide, the key and motor are releaseably coupled to the lock operating mechanism so that when the key is inserted the motor is decoupled from the mechanism, preventing danger to a person holding the key.

3 Claims, 2 Drawing Sheets

FIG. 2
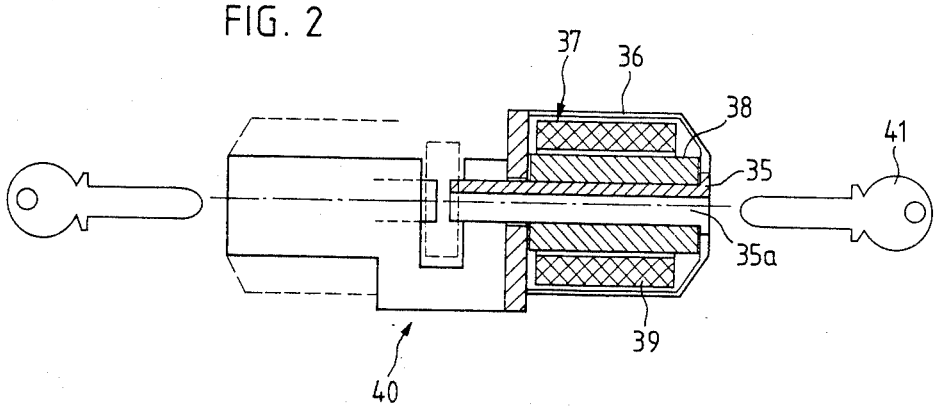
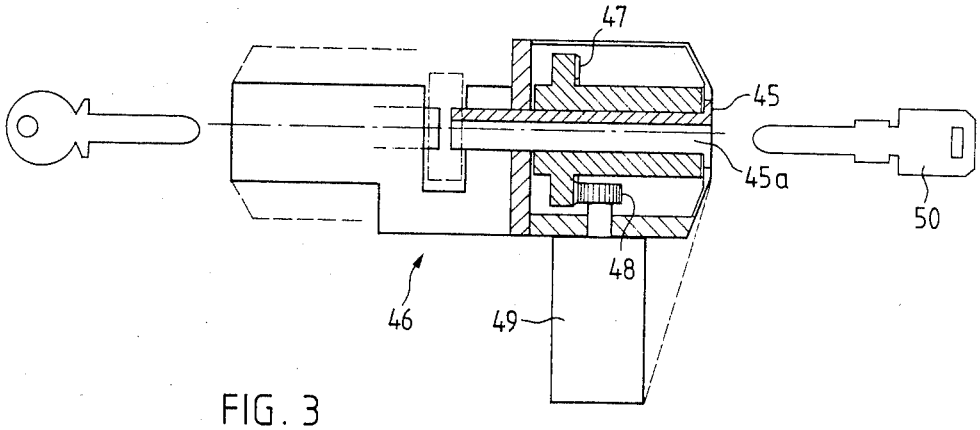
FIG. 3

MANUALLY OR ELECTRICALLY DRIVEN LOCK

The present invention relates to a safety lock cylinder means with an inner cylindrical rotor part rotatably mounted in an outer cylinder and which has a key guide and tumbler pins or bolts, which are under spring tension and associated therewith in bores of the inner cylindrical rotor part and outer cylinder, which are displaceably mounted therein, and a remotely operated motor drive.

BACKGROUND OF THE INVENTION

Lock cylinders are frequently used assembled with mortise locks, which have a bolt and/or latch for opening and closing doors.

A remotely controllable electrically operated mortise lock is known, which has the dimensions according to DIN 18250/1. It is possible with the aid of such remotely controllable mortise locks to indicate and monitor the state of a door or lock, namely "open" or "closed", optically and/or acoustically at a desired point either electrically or electronically. In this connection see, e.g., DE-OS No. 3309 962 A1.

In addition, DE-OS No. 3322 197 A1 discloses an electrically or electronically operated door lock in which a tumbler cooperates with a manually movable member, such as a door handle, which in turn operates a closing member, a bolt or a latch, which can block the movement of the tumbler so that the handle member cannot act on the closing member.

SUMMARY OF THE INVENTION

An object of the present invention is to provide a safety lock cylinder means enabling a door lock to be opened or closed manually from one side, i.e. with the aid of a key, and electrically or electronically from a remotely located point on the other side.

Another object of the invention is the construction of the safety lock cylinder means in such a way that during the manual closing the door, the electrical or electronic remote operability of the lock can be rendered inoperative. This ensures that the lock can be brought into the closed position by the remote control, but that the closing action can be manually overcome even when the door is closed by remote control, whereby the closure can be subsequently restored, and that during the manual locking process motor closure is not possible so that there is no risk of injury.

The objects of the present invention cannot completely be solved by known locks.

The objects of the invention are solved by the combination of the following features:

(a) two external cylinders which are coaxially arranged at a predetermined distance from one another and are fixed to one another by a U-shaped web, (b) in each case one of the two outer cylinders is mounted in rotary manner with an inner, cylindrically shaped rotor part, (c) in at least one of the two inner, cylindrically shaped rotor parts is provided a key guide, (d) a driver having a cam in operative connection with a bolt and/or latch is arranged so as to pivot about a theoretical axis between the two outer cylinders, (e) the two inner, rotatably mounted, cylindrically shaped rotor parts are constructed so as to be couplable in non-positive manner to the driver counter to the tension of springs, as desired, with he aid of a key via coupling members arranged between the pivotable driver and the two members arranged between the pivotable driver and the two rotatably mounted, cylindrically shaped rotor parts, (f) an inner, rotatably mounted, cylindrically shaped rotor part is in drive connection with a motor and, (g) on the motor is arranged a control and monitoring member enabling the motor to be operated from a remote point by an electronic operating command.

According to a further development of the invention, a spring is arranged on the one hand between a coupling member and the head of a tappet and on the other hand between another coupling member and the inner rotor part connected to the motor, in order to keep the two coupling members in a given starting position. There is also a control and monitoring member in operative connection with the motor in order to give an alternating rotary movement to the motor rotor.

According to another advantageous development of the invention an inner rotor part and outer cylinder of the safety combination lock are constructed as integral components of an electric motor, i.e., as a rotor and stator. To enable the lock to be manually operated from the outside, a key guide is provided within the inner, rotatable rotor part of an outer cylinder.

In another advantageous development of the invention, an inner rotor part of the safety combination lock mounted in rotary manner in an outer cylinder is in drive connection with a motor via a bevel drive gear and a pinion. Here again, if a key guide is desired, it can be arranged in an inner rotor part mounted in rotary manner in an outer cylinder.

BRIEF DESCRIPTION OF THE DRAWING

Further advantageous structural possibilities of the invention can be gathered from the following description. The invention is described in greater detail hereinafter relative to three non-limitative embodiments and the attached drawings, wherein:

FIG. 2 is a similar view of a second embodiment;

FIG. 3 is a similar view of a third embodiment; and;

DESCRIPTION OF THE PREFERRED EMBODIMENT

Figure 1:
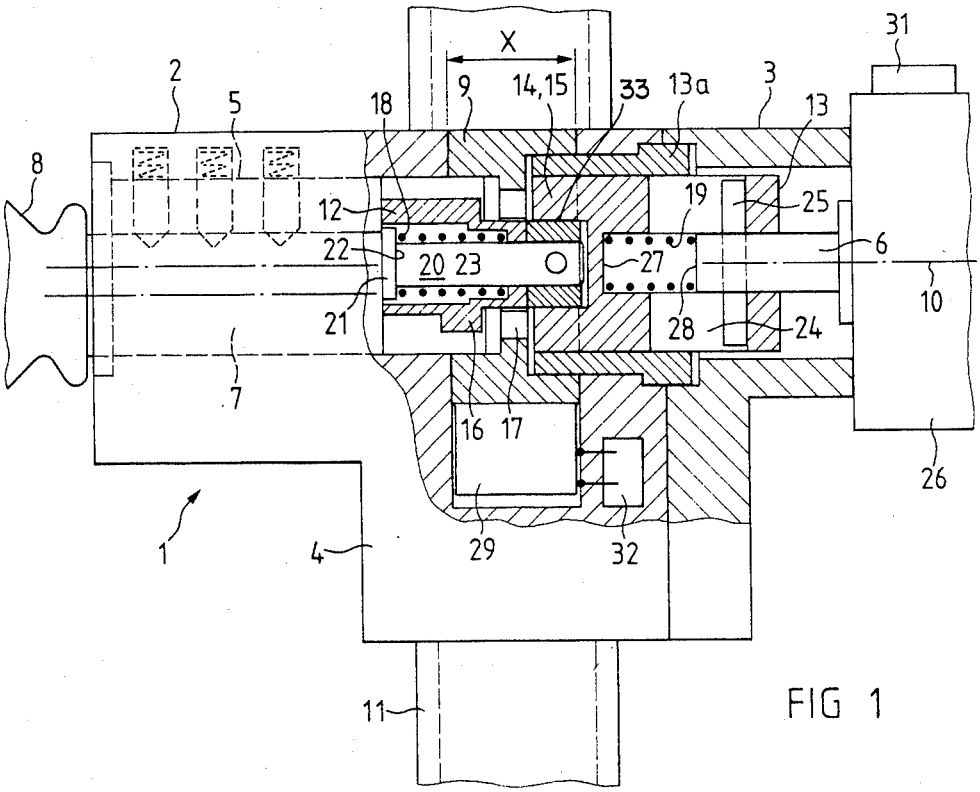
FIG. 1 is a partial longitudinal section through a lock according to one embodiment of the inventions.

Referring first to FIG. 1 the illustrated safety lock cylinder means 1 has two outer cylinders 2,3 arranged coaxially at a predetermined distance X from one another, the cylinders being fixed to one another by a U-shaped web 4. In each of the two outer cylinders 2,3 is provided a cylindrically shaped rotor part 5, 6. The rotor parts are mounted for rotary movement in their respective cylinders and in this embodiment are constituted by a lock cylinder rotor 5 and an inner cylindrical rotor part 6. A key channel 7 for receiving a key 8 is provided in at least one of the two rotatably mounted rotor parts 5,6, in this case the lock cylinder rotor 5.

Between the two outer cylinders 2,3 and the two inner rotor parts 5,6 rotatably mounted therein is a driver 9 having a cam 29 mounted so as to rotatably reciprocate about the common theoretical axis 10 of rotor parts 5,6. Driver 9 or cam 29 thereof is in operative connection with a bolt and/or latch (not shown) of a mortise lock 11 in such a way that the bolt and/or latch is moved into the "open" or "closed" position on pivoting driver 9 about axis 10 clockwise or counterclockwise, respectively.

Between the driver 9 and the two inner rotor parts 5,6, respectively, are provided coupling members 12 and 13, with the aid of which driver 9 can be coupled, as desired, with either or both of the rotary lock cylinder rotor 5 and with the other rotary rotor part 6. The two coupling members 12,13 are mounted so as to rotate about the common theoretical axis 10 of rotor parts 5,6 and the driver 9.

The two coupling members 12,13 are non-rotatably connected with respect to the two inner rotor parts 5,6 while at the same time being axially reciprocatable with respect to the two inner rotor parts, the lock cylinder rotor 5 and the cylindrically shaped rotatable rotor part 6, as well as the driver 9.

In the starting position, i.e., without key 8 fully inserted in the key guide 7, the inner rotor part 6 is connected non-positively via coupling member 13 to driver 9 by means of claws 14 arranged thereon and claws 15 on coupling member 13, whereas there is no connection between claws 16 arranged on coupling member 12 and claws 17 arranged on driver 9.

The two coupling members 12,13 are automatically held in the aforementioned starting position with the aid of springs 18,19 provided that no other position of the two coupling members 12,13 is brought about by the key 8 which is axially reciprocatable in key guide 7. In this way the cylinder lock is constantly remotely controllable, except during the manual operation of lock cylinder 5 with a key, during which time motor closure is not desired. The motor control can be designed in such a way that outside the given "open" time, closure is automatically restored after a few seconds following each manual operation.

Coupling member 13 is mounted at one end of an actuator including a shaft or tappet 20 and bushing 13a, whose axis of symmetry coincide with the axis 10 of coupling member 13, while coupling member 12 is mounted so as to loosely rotate on tappet 20.

Tappet 20 is provided at one end with a disc-like, flattened head 21, which forms a circular bearing surface 22 for one end of spring 18, the other end of which abuts a circular surface 23 located on coupling member 12. At its other end a circular bushing 33 is pinned to tappet 20 and rests in a recess in the end of member 13 between claws 15.

Coupling member 13 is provided with a slot 24 in which is arranged a transverse rod 25 fixed to the rotatable, inner, cylindrically shaped rotor part 6, so that coupling member 13 is axially reciprocatable with respect to rotor part 6, but is connected in non-rotary manner to and with respect to the same. Rotor part 6 is in drive connection with a geared motor 26, the latter preferably being in drive connection with rotor part 6 by means of a mitre gear.

Bearing surfaces 27 and 28, against which spring 19 acts, are provided, respectively, on coupling member 13 and on one end of the cylindrically shaped rotor part 6.

Figure 4:
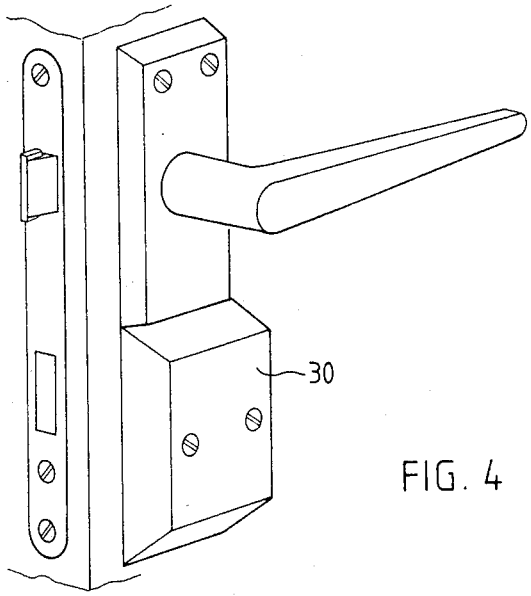
FIG. 4 is a perspective view of a safety combination lock in accordance with the invention inserted in a door.

Geared motor 26 is constructed so that it is secure against a force transfer taking place axially or at an angle to the cylindrically shaped inner rotor part 6. For this purpose, the motor is flanged to the inside of the door in the mounting region and is covered by a cover 30, as shown in FIG. 4.

On motor 26 is provided a control and monitoring unit 31 which enables the motor, and hence the lock, to be operated from a remote point by an electronic operating command. The rotation direction of the geared motor 26 or rotor part 6, either clockwise of counterclockwise, is preferably controlled by means of a limit switch on the lock bolt (not shown). However, an alternating rotary movement directly from driver 9 can also be monitored and controlled by means of a micro-operating command generator 32, if this is desired. Locks with multi-speed bolt thrust can also be driven with the aid of the geared motor.

A second embodiment of the invention is shown in FIG. 2 wherein the inner rotor part 35 and the outer cylinder 36 of the safety lock cylinder 40 are integral components of an electric motor 37 having a rotor 38 and stator 39. A key channel **35*a* is provided in the inner rotor part 35 enabling the safety lock cylinder 40 to be turned manually in both directions from the outside with the aid of a key 41**, should this prove necessary, e.g., in the case of a power failure.

In the third embodiment shown in FIG. 3, a cylindrically shaped, inner rotor part 45 of the safety lock cylinder 46 is in drive connection with a geared motor 49 via a bevel drive gear 47 and a pinion 48. Here, again, a key guide **45*a* is provided in rotor part 45 enabling the safety lock cylinder 46** to be rotated in both directions with the aid of a key, should this prove necessary.

The safety lock cylinder means is operated in the following way:

MOTOR OPERATION

Geared motor 26 is in drive connection with the driver 9 via cylindrical rotor part 6, transverse rod 25, coupling member 13 and claws 14,15. Geared motor 26 is put into operation by an electronic operating command and, as a function of the position of the limit switch on the lock bolt or as a function of the position of the micro-operating command generator 31, driver is rotated clockwise or counter clockwise and the cam 29 of driver 9 which is in operative connection with the bolt and/or a latch of the mortise lock 11 moves the bolt or latch into the "closed" or "open" positions.

MANUAL OPERATION

For manual operation of the safety combination lock 1, the coupling member 13 is moved axially by key 8 inserted in the key guide 7. The key pushes tappet 20 and head 21 thereof in the direction of geared motor 26 counter to the tension of spring 19, to the right as shown in FIG. 1, for enough so that the previously existing non-positive connection between claws 14,15 of driver 9 or coupling member 13 has been broken while simultaneously, also as a result of insertion of key 8 in key guide 7, coupling is accomplished between claws 16 of coupling member 12 and claws 17 of driver 9.

The motor-side coupling member 13 can in other words be put out of operation by means of key 8 and tappet 20. Independently of the position of driver 9, key 8 can in all cases be inserted in the key guide 7 of the inner, cylindrically shaped rotor part 5 and the lock cylinder rotor 5 can always be rotated in both directions.

The safety lock cylinder means, which has a double function and which is very suitable for both remotely controlled motor operation and for manual operation, can be fitted into commercially available mechanical mortise locks with the dimensions according to DIN 18250/1. The safety lock cylinder means can be extended at random on either side and can be manufactured with all profile dimensions (KABA, Hahn, etc.).

With the aid of the safety combination lock, the closing and opening function brought about by remote control can be realized in a simple manner without any loss of safety or security.

I claim:

1. A safety lock comprising a frame including means defining first and second coaxial cylindrical cavities and an interconnecting web therebetween;

first and second cylindrical rotors rotatably mounted, respectively, in said first and second cavities and having a common axis with said cavities;

a key slot in at least said first rotor for receiving a key, said rotor including spring-urged tumbler pins for cooperating with said key to control the rotatability of said first rotor;

a remotely operable drive motor coupled to said second rotor;

a bolt;

a driver pivotably mounted in said frame, said driver having a cam in operative connection with said bolt so that pivoting said driver moves said bolt;

first means attached to said first rotor for rotation therewith, said first means being releasably coupleable to said driver;

first spring means urging said first means into coupling engagement with said driver, said first means being moved into coupling engagement with said driver by insertion of a key in said slot so that said lock can be operated manually;

second means attached to said second rotor for rotation therewith, said second means being releasably coupled to said driver;

second spring means urging said second means into coupling engagement with said driver;

and actuator means between said first and second releasably coupled means for decoupling said second rotor from said driver when a key is fully inserted into said key slot to prevent said lock from being operated by said motor when it is being manually operated.

2. A lock according to claim 1 wherein said driver includes means defining a non-circular opening, and wherein each of said first and second means includes a coupling member matable with said opening to form a rotatable driving coupling.

3. A lock according to claim 1 wherein said actuator means includes a shaft extending from an inner end of said key slot to said coupling member of said second means to push said coupling member of said second means out of engagement with said driver when said key is inserted and pushed against said shaft to thereby decouple said motor from said driver.

* * * * *